United States Patent [19]

Bender

[11] Patent Number: 4,664,078

[45] Date of Patent: May 12, 1987

[54] CONTINUOUSLY ROTATING INTERNAL COMBUSTION ENGINE

[76] Inventor: Friedrich K. Bender, 14557 Chere Dr., Whittier, Calif. 90604

[21] Appl. No.: 775,816

[22] Filed: Sep. 13, 1985

[51] Int. Cl.[4] ..... F02B 53/00

[52] U.S. Cl. ..... 123/245; 418/34; 418/35

[58] Field of Search ..... 123/245; 418/33, 34, 418/35

[56] References Cited

U.S. PATENT DOCUMENTS

| | | | |
|---|---|---|---|
| 915,296 | 3/1909 | Holloway | 418/34 |
| 1,142,576 | 6/1915 | Inshaw | 418/34 |
| 1,305,966 | 6/1919 | Green | 123/245 X |
| 1,981,615 | 11/1934 | Enderlin | 418/34 |

FOREIGN PATENT DOCUMENTS

| | | | |
|---|---|---|---|
| 3444023 | 6/1985 | Fed. Rep. of Germany | 123/245 |
| 396253 | 8/1933 | United Kingdom | 418/34 |

*Primary Examiner*—Michael Koczo

*Attorney, Agent, or Firm*—Edgar W. Averill, Jr.

[57] ABSTRACT

A substantially continuously rotating internal combustion engine. The engine has a rotatable casing with a hollow cylindrical interior cavity which includes one or more partition members. A shaft and vane assembly is also held within the cavity, and the shaft and vane assembly has the same number of vanes as the casing has partitions. The engine is a four-cycle internal combustion engine, and both the casing and the vanes rotate, and each provides power to the output gear.

15 Claims, 8 Drawing Figures

4
4
6
6
7
7
3
3
5
5
10
11
12
13
14
15
16
17
18
19
9
20
20'
21
22
23
24
25
26
27
28
29
30
34
35
36
37
45
45'
45''
54
56
57
58
58'
59
60
63
64
67
67'
68
69
70
71
72
73
74
76

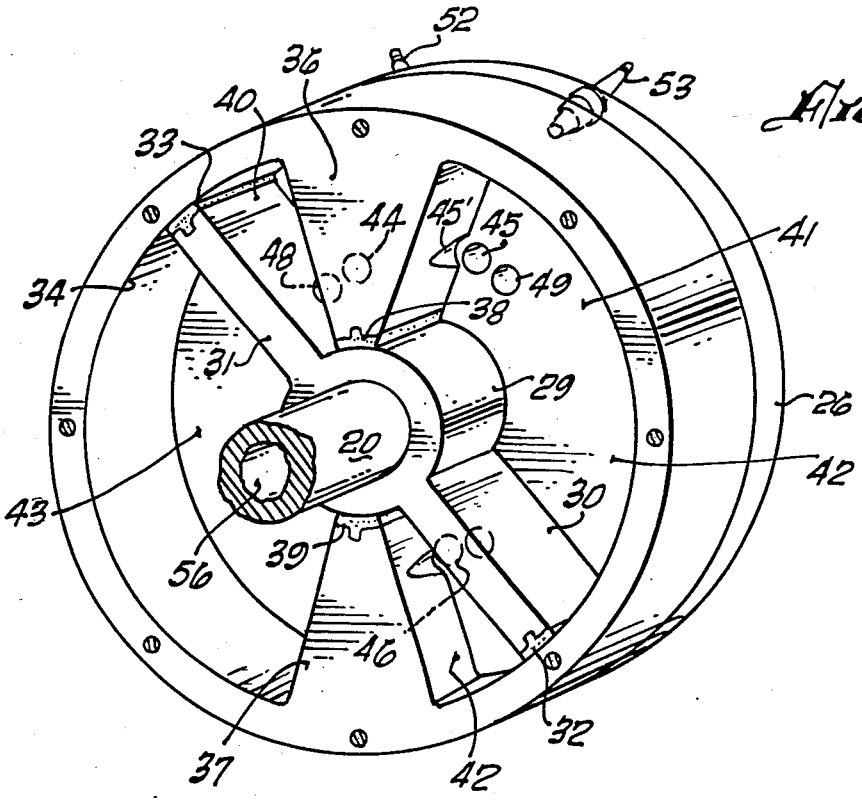
FIG. 2.
FIG. 3.
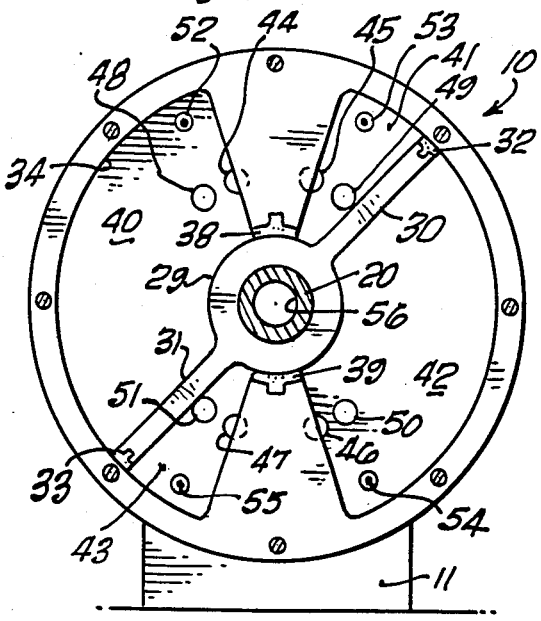
FIG. 4.
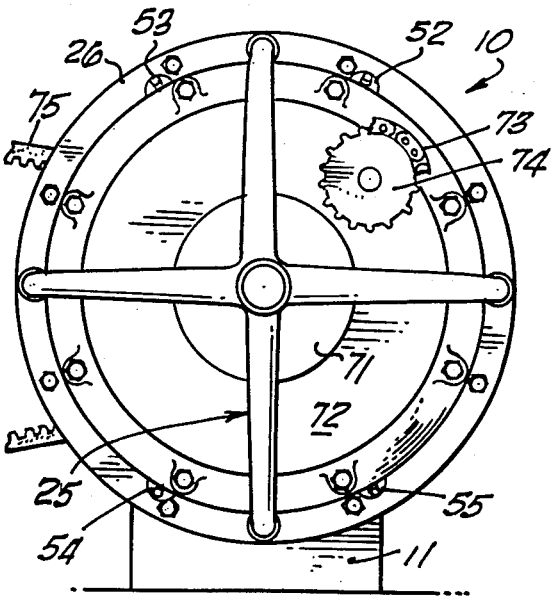

CONTINUOUSLY ROTATING INTERNAL COMBUSTION ENGINE

BACKGROUND OF THE INVENTION

The field of the invention is engines and the invention relates more particularly to internal combustion engines having a rotating vane.

Rotary engines have found limited acceptance in production vehicles. Early models exhibited difficulty with seals and there has been no widespread move to replace the typical piston engine with rotary engines.

Applicant has heretofore devised a rotating fluid-driven rotary actuator, having a hollow casing with a partition member abutting a shaft and vane assembly. A series of one-way bearings transmitted rotary motion from both the casing and the shaft and vane assembly to an output gear. The present invention is of the same generic type of motor but is adapted for internal combustion operation rather than on a hydraulic fluid as set forth in applicant's earlier application Ser. No. 718,647.

SUMMARY OF THE INVENTION

It is an object of the present invention to provide an internal combustion engine of unusually high efficiency utilizing the movement both of the casing and of the vane to provide power to an output gear.

The present invention is for a substantially continuous rotating internal combustion engine having a base which supports a rotatable casing. The rotatable casing has a hollow cylindrical interior cavity having an input face plate and an output face plate and an outer peripheral ring. The casing has at least one partition member which extends radially from the interior surface of the peripheral ring toward the center of the casing. A first hollow sleeve at the output end of the casing supported by a bearing affixed to the base, which bearing surrounds the first hollow sleeve and permits rotation in a first direction only. A shaft and vane assembly also has an input end and output end and is held by the casing and positioned axially therein and is supported by the first hollow sleeve of the casing. The shaft portion of the shaft and vane assembly abuts each partition member of the casing and there is a vane affixed to the shaft or each partition member in the casing. Each vane and partition pair creates two chambers and the shaft and vane assembly is held by a bearing which also permits rotation in a first rotational direction only. Gas flow control means are held by the base and have a plurality of combustible gas passageways and an plurality of exhaust passageways, each of said passageways having openable and closeable valves connected to each of said chambers of the hollow cylindrical interior cavity. Spark plug means is positioned in each chamber and are held by the casing. Timing means open and close the valves at appropriate times, and an output gear is supported by a pair of bearings, one which connects to the first hollow sleeve of the casing and one which connects to the shaft of the shaft and vane assembly. In this way, movement of both the casing and the shaft and vane assembly are transmitted to the output gear which, thus, is in continual rotation when the motor is operating.

BRIEF DESCRIPTION OF THE DRAWINGS

FIG. 2 is a perspective view showing the internal portion of the casing of the engine of FIG. 1.

FIG. 3 is an end view taken along line 3—3 of FIG. 1.

FIG. 4 is an end view from the exhaust end of the engine of FIG. 1.

DESCRIPTION OF THE PREFERRED EMBODIMENTS

Figure 1:
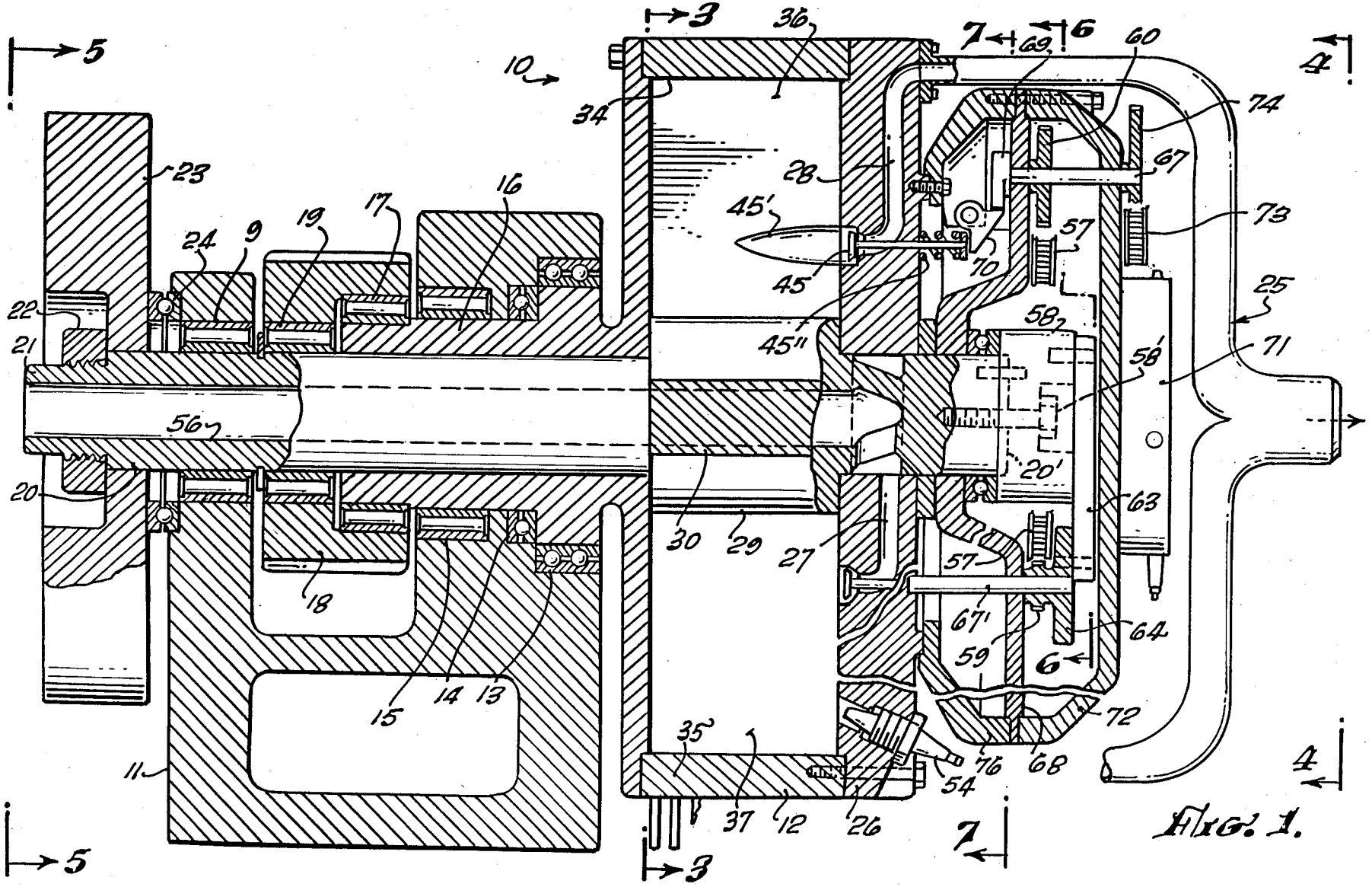
FIG. 1 is a side view mostly in cross-section of the internal combustion engine of the present invention.
Figure 5:
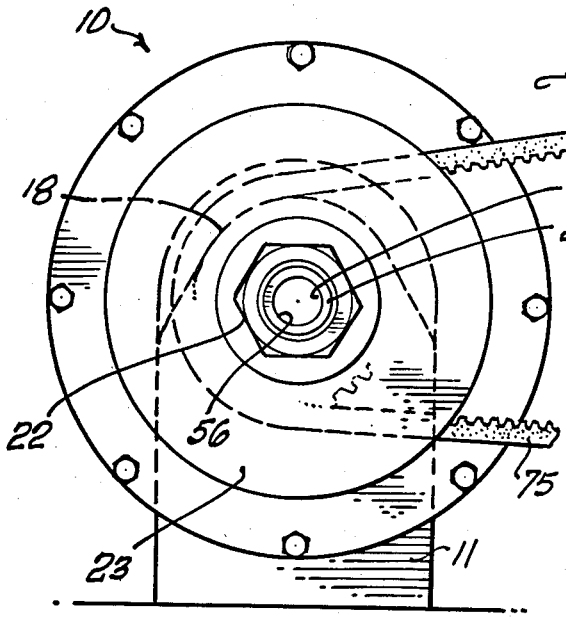
FIG. 5 is an end view of the flywheel end of the engine of FIG. 1.

The internal combustion engine of the present invention is shown in cross-sectional view in FIG. 1 and indicated generally by reference character 10. Engine 10 has a base 11 which supports a rotatable casing 12 which is held at base 11 by bearings 13 and 14 and also by a one-way bearing 15 which permits rotation of the casing in a first direction only, and prevents it from moving in the opposite direction. The bearings are positioned around the exterior of a hollow sleeve 16 at the output end of casing 12. A one-way bearing 17 provides support for an output gear 18. One-way bearing 17 permits rotation in a second direction only, which is the opposite direction as that permitted by one-way bearing 15. Output gear 18 is also supported by a second one-way bearing 19 which, like bearing 17, also permits rotation in a second direction only. Bearing 19 is supported by hollow shaft 20 which is connected and forms a portion of the shaft and vane assembly discussed below. As shown in FIG. 1, shaft 20 is held to base 11 by one-way bearing 9.

The output end 21 of shaft 20 is threaded and supports a nut 22 which holds flywheel 23 onto shaft 20. Flywheel 23, shaft 20 and vanes 30 and 31 should have a mass approximately equal to the casing assembly and its associated exhaust manifold and the like so that the two rotating assemblies will each have about the same mass. Flywheel 23, of course, also smooths the rotational movement of output gear 18. A bearing 24 permits tightening the flywheel against base 11.

At the exhaust end of internal combustion engine 10 is an exhaust manifold 25 which is bolted to plate 26 at the exhaust end of rotatable casing 12. Plate 26 contains passageways for a combustible gas mixture such as passageway 27 and passageways for exhaust gas such as passageway 28. A shaft and vane assembly has a center section 29 which is integral with hollow shaft 20 and which is also integral with a pair of vanes 30 and 31 shown in FIGS. 2 and 3. Vanes 30 and 31 have seal members 32 and 33, respectively, at the outer terminus of the vanes which abuts the interior surface 34 of the outer peripheral ring 35 of rotatable casing 12. Seal members should also be used along the sides of the vanes.

A pair of partitions 36 and 37 extend from outer peripheral ring 35 inwardly until they contact the center section 29 of the shaft and vane assembly. A pair of seals 38 and 39 contact the center section and are, preferably, replaceable when necessary.

It can be seen that the two vanes and the two partitions form four chambers 40 through 43. It can also be seen in FIG. 3 that each chamber has a pair of valves comprising exhaust valves 44 through 47 and intake valves 48 through 51. Each chamber also has a spark plug 52 through 55.

In operation, the output end 21 of shaft 20 is attached to a carburetor or other source of combustible gas which passes through the center passageway 56 and is led to each of the four chambers 40 through 43 at the appropriate cycle through, for instance, passageway 27 shown in FIG. 1. This, of course, is in the intake cycle as also described more fully below. After combustion in the exhaust stage, exhaust gasses are fed out through appropriate exhaust passageways such as passageway 28 shown in FIG. 1 and into the exhaust manifold which is connected to a fixed pipe by way of a ceramic coupling seal or other appropriate means.

Figure 6:
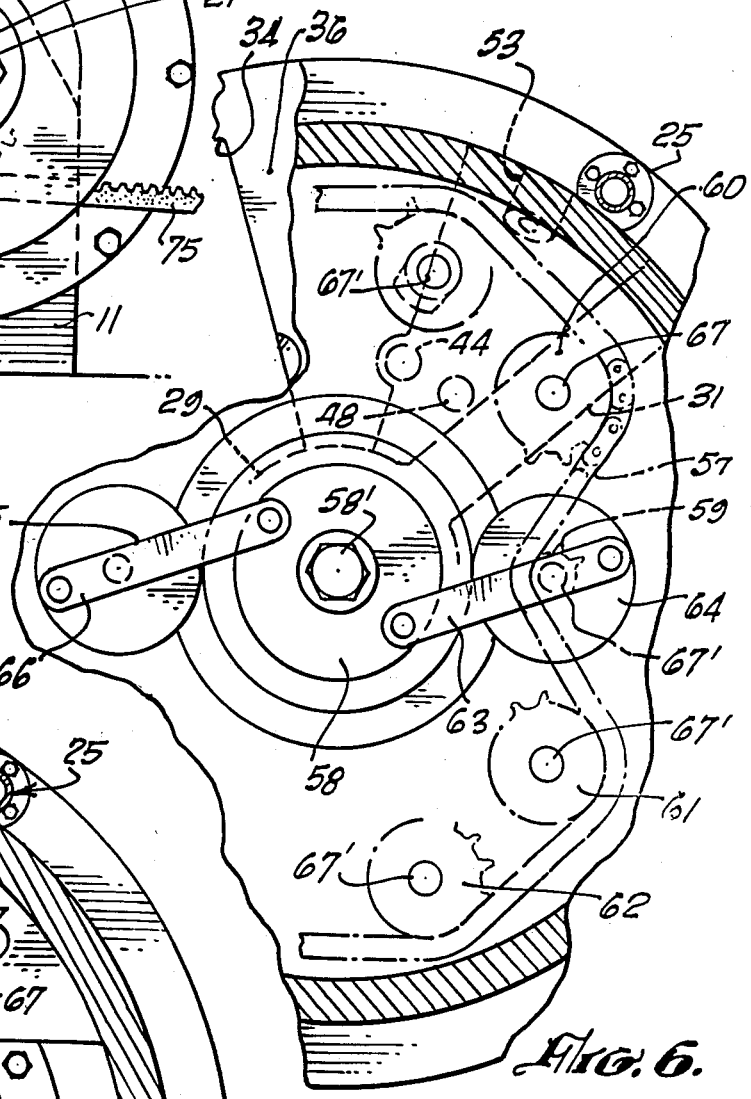
FIG. 6 is an enlarged view taken along line 6—6 of FIG. 1 showing the timing mechanism of the engine of FIG. 1.

The operation of the timing of the valves is indicated in FIG. 6 of the drawings where it is schematically shown that timing chain 57 passes over a plurality of gears 59 through 62. Gear 59 is driven by timing disk 58 through link 63 pinned to disk 64. Similarly, a link 65 is affixed to a disk 56 which, of course, is also affixed to timing chain 57 in a manner analogous to disk 64 and gear 59. It can be seen from returning to FIG. 1 that gear 60 drives shaft 67 which is held in a bearing held by interior plate 68 and is also affixed to a cam 69. Cam 69 drives cam follower 70 which, in turn, opens and closes valve 45. The other valves, of course, are timed in a similar manner and other shafts are all indicated by reference character 67'.

Although not essential, it permits the input and output valves to be closer to the partitions if a groove such as groove 45', as shown in FIGS. 1 and 6, are formed in the surface of the various partitions such as partition 36.

A method of providing ignition is shown in FIG. 1 where a magneto assembly 71 is held at outer plate 72 and driven by a timing chain 73 which passes over a series of gears and is driven by gear 74 which is affixed to shaft 67 which is held by bearings in interior plate 68 and outer plate 72.

Figure 7:
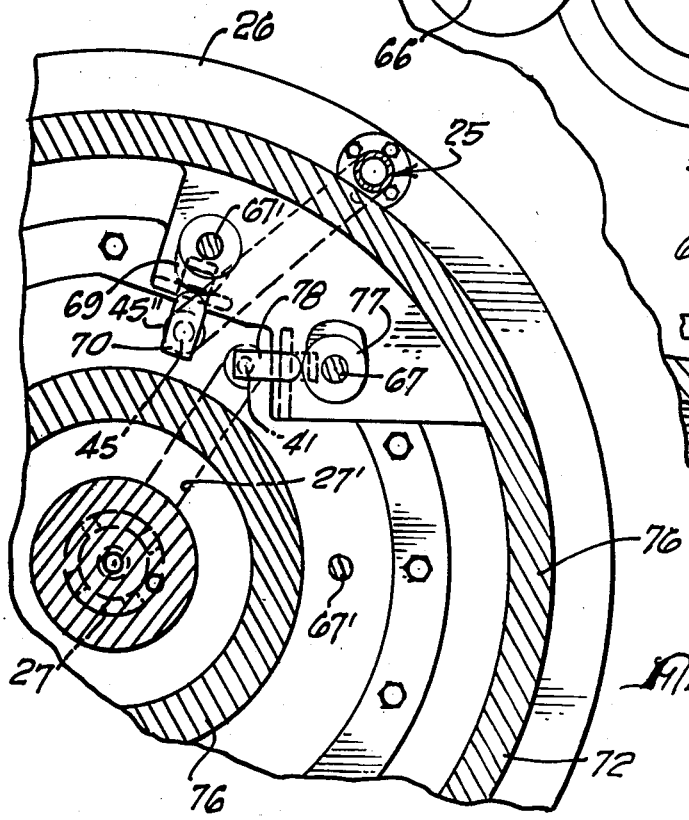
FIG. 7 is a cross-sectional view taken along line 7—7 of FIG. 1.

The passageways for intake combustible gas and exhaust gas are indicated in FIG. 7 of the drawings where it can be seen that an inner plate 76 hold the cam follower, such as cam follower 70, which controls valve 45 which has a valve spring 45''. Similarly, a cam 77 rotates and moves cam follower 78 which controls the opening and closing of valve 41 to control the passage of combustible gas through passageway 27'. As can be seen in FIG. 1, a nut 58' holds timing disk 58 to the exhaust end 20' of hollow shaft 20. A bearing 79 enables movement of the shaft and vane assembly with respect to inner plate 76, interior plate 68 and outer plate 72, together with their associated gears, timing chains and the like. The drawings, of course, show the engine of the present invention in a schematic manner, and other features such as cooling vanes and additional bearings and sleeves would be used but their illustration is believed not necessary for an understanding of the present invention.

Figure 8:
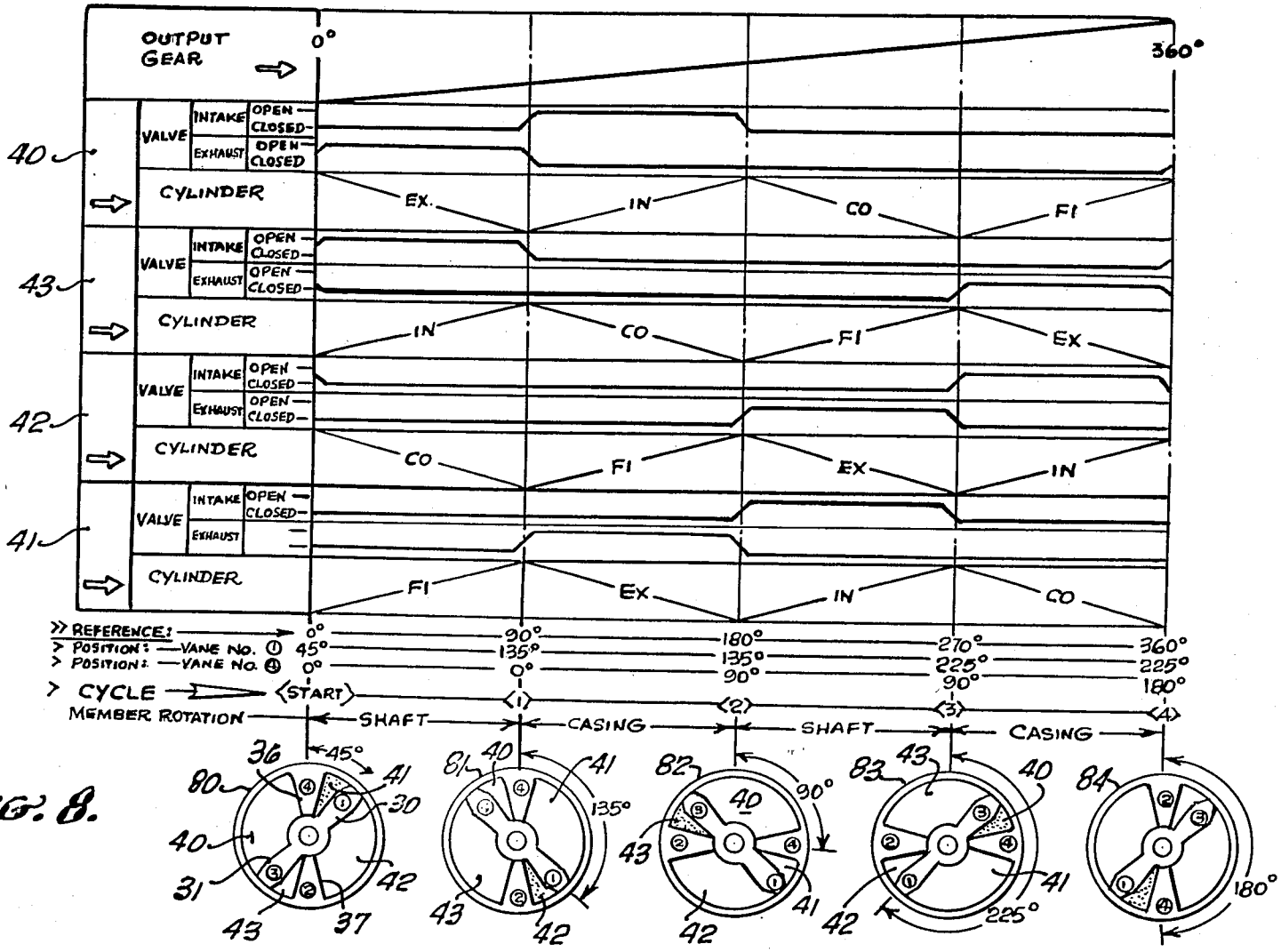
FIG. 8 is a graphic representation of the firing, exhaust, intake and compression stages of each of the four chambers of the engine of FIG. 1.

The four cycles of the invention are graphically depicted in FIG. 8 of the drawings. More extreme positions of the shaft and vane assembly with respect to the rotatable casing are shown at the bottom of the figure and indicated by reference characters 80, 81, 82 and 83; 84, of course is analogous to the position at 80, except it is rotated one hundred eighty degrees. At the position indicated by reference character 80, the spark plug in chamber 41 is firing which moves vane 30 away from partition 36 where it is also compressing the gas in chamber 42. At the position indicated by reference character 81, the spark plug in chamber 42 is firing and this moves the partition 37 away from the vane 30. It is clear in this representation that both the vane and the casing rotate. As the casing rotates, the one-way bearing 17 imparts rotational motion to the output gear 18 whereas in the first cycle the one-way bearing 19 imparts rotary motion from shaft 20 to the output gear. Thus, there is no idle return motion as in a normal reciprocated piston engine. As the casing reaches the position indicated by reference character 82, it has compressed combustible gas in chamber 43 which begins to fire at this point and drives vane 31 toward partition 36, compressing the gas in chamber 40 which then fires driving partition 36 to the position indicated by reference character 84. The various exhaust, intake, combustion and firing steps are shown for each of the four chambers in the graph above. The position of the intake and exhaust valves is also shown at each step. It can also be seen that for each one hundred eighty degree turn of the casing, as from position 80 to position 84, the output gear has moved twice this far. That is, the casing has made a one hundred eighty degree turn, but the output gear has made a three hundred sixty degree turn.

The efficiency of the present internal combustion engine is believed to exceed the efficiency of any conventional engine. The engine may be readily air cooled because of the accessibility of rotatable casing 12 to the air. The materials of construction may be those commonly used for gasoline engines such as aluminum alloy and steel, and conventional fuels may be readily used.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

What is claimed is:

1. A substantially continuously rotating internal combustion engine comprising:

a base;

a rotatable casing having a hollow cylindrical interior cavity having an exhaust face plate and an output face plate and an outer peripheral ring, said casing having at least one partition member extending radially from the interior surface of said peripheral ring, a first hollow sleeve at the output end thereof, an exhaust pipe centered at the axis of rotation of the casing at the exhaust end thereof having a plurality of passageways connected between said pipe and the interior of said casing for conveying exhaust gasses out of said casing, said exhaust pipe rotating with said casing, said casing being held by said base by a first bearing affixed to said base and surrounding said first hollow sleeve, said first bearing permitting rotation in a first rotational direction only;

a shaft and vane assembly also having an exhaust end and an output end, said assembly being held by said casing and positioned axially therein and supported by said first hollow sleeve, said shaft and vane assembly having a shaft portion which abuts the partition member of said casing and at least one vane, the terminus of which abuts the interior surface of said outer peripheral ring of the casing creating at least two chambers, one on each side of each partition member within said hollow cylindrical interior cavity, said shaft and vane assembly being held by a bearing which permits rotation in a first rotational direction only;

gas flow control means held by said rotatable casing, said gas flow control means having a plurality of combustible gas passageways and a plurality of exhaust gas passageways, each of said passageways having openable and closeable valves connected to each of said chambers of said hollow cylindrical interior cavity;

spark plug means in each chamber held by said rotatable casing;

timing means to open and close said valves; and output gear means supported by a bearing which permits rotation in a second direction only, which bearing is held by said first hollow sleeve of said casing and said output gear also being supported by a bearing which permits rotation in a second direction only, which bearing is held by said output end of said shaft portion of said shaft and vane assembly.

2. The internal combustion engine of claim 1 further including a flywheel affixed to the shaft portion of said shaft and vane assembly.

3. The internal combustion engine of claim 1 wherein said gas flow control means is held by said rotatable casing.

4. The internal combustion engine of claim 3 wherein said gas flow control means rotates with said rotatable casing.

5. The internal combustion engine of claim 4 wherein said exhaust gas passageways are affixed to said rotatable casing and rotate in conjunction therewith.

6. The internal combustion engine of claim 1 wherein said combustible gas passageways are supplied through a gas passageway located in said shaft portion of said shaft and vane assembly at the output end thereof.

7. The internal combustion engine of claim 1 wherein said timing means are affixed to the exhaust end of said shaft and vane assembly.

8. The internal combustion engine of claim 1 wherein said valves are held by the exhaust face plate of rotatable casing.

9. The internal combustion engine of claim 1 wherein said spark plug means are held by the exhaust face plate of said rotatable casing.

10. The internal combustion engine of claim 1 wherein said timing means comprises a timing chain held by a plurality of timing gears held by a disk affixed to said output face plate of said rotatable casing.

11. The internal combustion engine of claim 10 wherein at least one of said timing gears are operated by a link affixed to a disk affixed to said timing gear and to a disk affixed to said exhaust end of said shaft and vane assembly.

12. A substantially continuously rotating internal combustion engine comprising:

a base;

a rotatable casing having an exhaust end and an output end and having a hollow cylindrical interior cavity having an exhaust face plate and an output face plate and an outer peripheral ring, said casing having a pair of partition members extending radially from the interior surface of said peripheral ring, a first hollow sleeve at the output end thereof, an exhaust pipe centered at the axis of rotation of the casing at the exhaust end thereof, having a plurality of passageways connected between said pipe and the interior of said casing for conveying exhaust gasses out of said casing, said casing being held by said base by a first bearing affixed to said base and surrounding said first hollow sleeve, said first bearing permitting rotation in a first rotational direction only;

a shaft and vane assembly having an exhaust end and an output end, said assembly being held by said casing and positioned axially therin and supported by said first hollow sleeve, said shaft and vane assembly having a shaft portion which abuts the partition member of said casing and a pair of vanes, the terminus of each abuts the interior surface of said outer peripheral ring of the casing creating first, second, third and fourth chambers within said hollow cylindrical interior cavity, said shaft and vane assembly being held by a bearing which permits rotation in a first rotational direction only;

gas flow control means held by said exhaust face plate, said gas flow control means having four combustible gas passageways connected to a hollow center conduit formed axially in said shaft portion of said shaft and vane assembly and first, second, third and fourth exhaust gas passageways, each of said passageways having an openable and closeable valve connected to each of said chambers of said hollow cylindrical interior cavity and an exhaust gas outlet passageway connected to an exhaust manifold affixed to said rotatable casing;

spark plug means in each chamber held by said rotatable casing;

timing means to open and close said valves; and output gear means supported by a bearing which permits rotation in a second direction only, which bearing is held by said first hollow sleeve of said casing and said output gear also being supported by a bearing which permits rotation in a second direction only, which bearing is held by said output end of said shaft portion of said shaft and vane assembly.

13. The internal combustion engine of claim 12 further including seal means on the contact area between the partition members and the shaft portion of said shaft and vane assembly.

14. The internal combustion engine of claim 12 further including seal means on the contact area between the terminus of each vane and the interior surface of the outer peripheral ring.

15. A substantially continuously rotating internal combustion engine comprising:

a base;

a rotatable casing having a hollow cylindrical interior cavity having an exhaust face plate and a output face plate and an outer peripheral ring, said casing having at least one partition member extending radially from the interior surface of said peripheral ring, a first hollow sleeve at the output end thereof, an exhaust pipe centered at the axis of rotation of the casing at the exhaust end thereof having a plurality of passageways connected between said pipe and the interior of said casing for conveying exhaust gasses out of said casing, said exhaust pipe rotating with said casing, said casing being held by said base by a first bearing affixed to said base and surrounding said first hollow sleeve;

a shaft and vane assembly also having an exhaust end and an output end, said assembly being held by said casing and positioned axially therein and supported by said first hollow sleeve, said shaft and vane assembly having a shaft portion which abuts the partition member of said casing and at least one vane, the terminus of which abuts the interior surface of said outer peripheral ring of the casing creating at least two chambers, one on each side of each partition member within said hollow cylindrical interior cavity, said shaft and vane assembly being held by a bearing;

gas flow control means held by said rotatable casing, said gas flow control means having a plurality of combustible gas passageways and a plurality of exhaust gas passageways, each of said passageways having openable and closeable valves connected to each of said chambers of said hollow cylindrical interior cavity;

spark plug means in each chamber held by said rotatable casing;

timing means to open and close said valves; and output gear means supported by a bearing which transmits rotation in a second direction only, which bearing is held by said first hollow sleeve of said casing and said output gear also being supported by a bearing which transmits rotation in a second direction only, which bearing is held by said output end of said shaft portion of said shaft and vane assembly.

* * * * *